US009450287B2

(12) United States Patent
Chang et al.

(10) Patent No.: US 9,450,287 B2
(45) Date of Patent: Sep. 20, 2016

(54) BROADBAND ANTENNA AND WIRELESS COMMUNICATION DEVICE EMPLOYING SAME

(71) Applicant: Chiun Mai Communication Systems, Inc., New Taipei (TW)

(72) Inventors: Yun-Jian Chang, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 196 days.

(21) Appl. No.: 14/278,093

(22) Filed: May 15, 2014

(65) Prior Publication Data

US 2014/0340281 A1 Nov. 20, 2014

(30) Foreign Application Priority Data

May 17, 2013 (TW) ..... 102117634 A

(51) Int. Cl.

| | |
|---|---|
| ***H01Q 1/24*** | (2006.01) |
| ***H01Q 1/22*** | (2006.01) |
| ***H01Q 7/00*** | (2006.01) |
| ***H01Q 5/357*** | (2015.01) |

(52) U.S. Cl.

CPC ..... *H01Q 1/22* (2013.01); *H01Q 1/243* (2013.01); *H01Q 1/245* (2013.01); *H01Q 5/357* (2015.01); *H01Q 7/00* (2013.01)

(58) Field of Classification Search

CPC ..... H01Q 1/243; H01Q 1/245; H01Q 5/357; H01Q 7/00

USPC ..... 343/702, 866, 741

See application file for complete search history.

(56) References Cited

U.S. PATENT DOCUMENTS

| | | | | |
|---|---|---|---|---|
| 8,619,000 | B2 * | 12/2013 | Shinkawa | H01Q 7/00 343/700 MS |
| 8,659,482 | B2 * | 2/2014 | Kim | H01Q 1/243 343/700 MS |
| 2013/0201074 | A1 * | 8/2013 | Harper | H01Q 1/38 343/870 |

* cited by examiner

*Primary Examiner* — Hoang V Nguyen
(74) *Attorney, Agent, or Firm* — Zhigang Ma

(57) ABSTRACT

Broadband antenna for wireless communication device is disclosed. The broadband antenna includes a grounding portion, a feeding portion, a connecting portion, a first radiation body connected to an end of the connecting portion, and second radiation body connected to another end of the connecting portion opposite to the first radiating body. The first radiating body and the second radiating body are symmetrical to each other with respect to the connecting body. The feeding portion is connected to an end of the first radiating body away from the second radiating body, the grounding portion is connected to an end of the second radiating body away from the first radiating body.

20 Claims, 4 Drawing Sheets

BROADBAND ANTENNA AND WIRELESS COMMUNICATION DEVICE EMPLOYING SAME

FIELD

The exemplary disclosure generally relates to antennas, and particularly to a broadband antenna and a wireless communication device employing same.

BACKGROUND

With improvements in the integration of wireless communication systems, broadband antennas have become increasingly important. In use, since the wireless communication device is used adjacently to the human body, lower SAR, which is the Radio Frequency (RF) power absorbed by the human body per unit of mass of an object (W/Kg), is necessary. SAR value of the standard of the Federal Communications Commission (FCC) specification must be less than 1.6 W/Kg.

BRIEF DESCRIPTION OF THE DRAWINGS

Many aspects of the embodiments can be better understood with reference to the drawings. The components in the drawings are not necessarily drawn to scale, the emphasis instead being placed upon clearly illustrating the principles of the disclosure.

DETAILED DESCRIPTION

Figure 1:
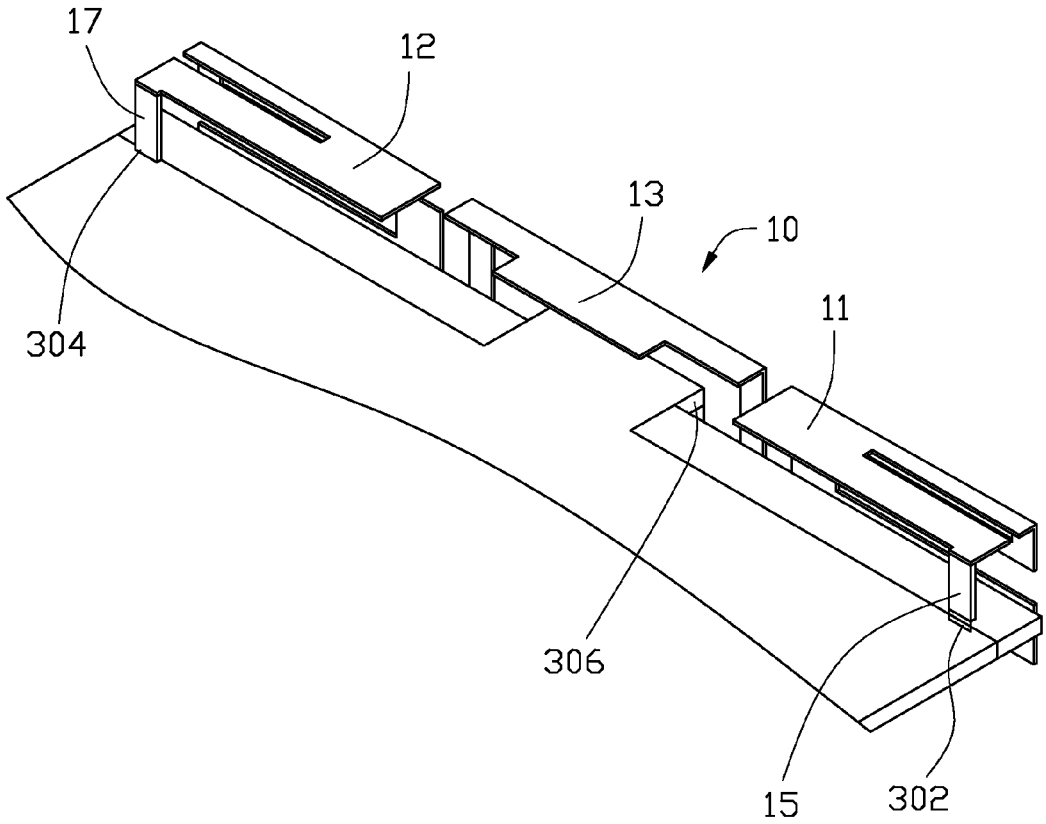
FIG. 1 is a partial perspective view of a first exemplary embodiment of a broadband antenna.

FIG. 1 is a partial perspective view of a first exemplary embodiment of a broadband antenna 10. The broadband antenna 10 is mounted on a printed circuit board (PCB) 30 of a wireless communication device, such as mobile phone, tablet computer, for example. The PCB 30 includes a feeding point 302, a grounding point 304 and a connector 306 located between the feeding point 302 and the grounding point 304. In one embodiment, the connector 306 is a universal serial bus (USB) connector. The connector 306 is positioned at a center point that is centered between the feeding point 302 and the grounding point 304.

Figure 2:
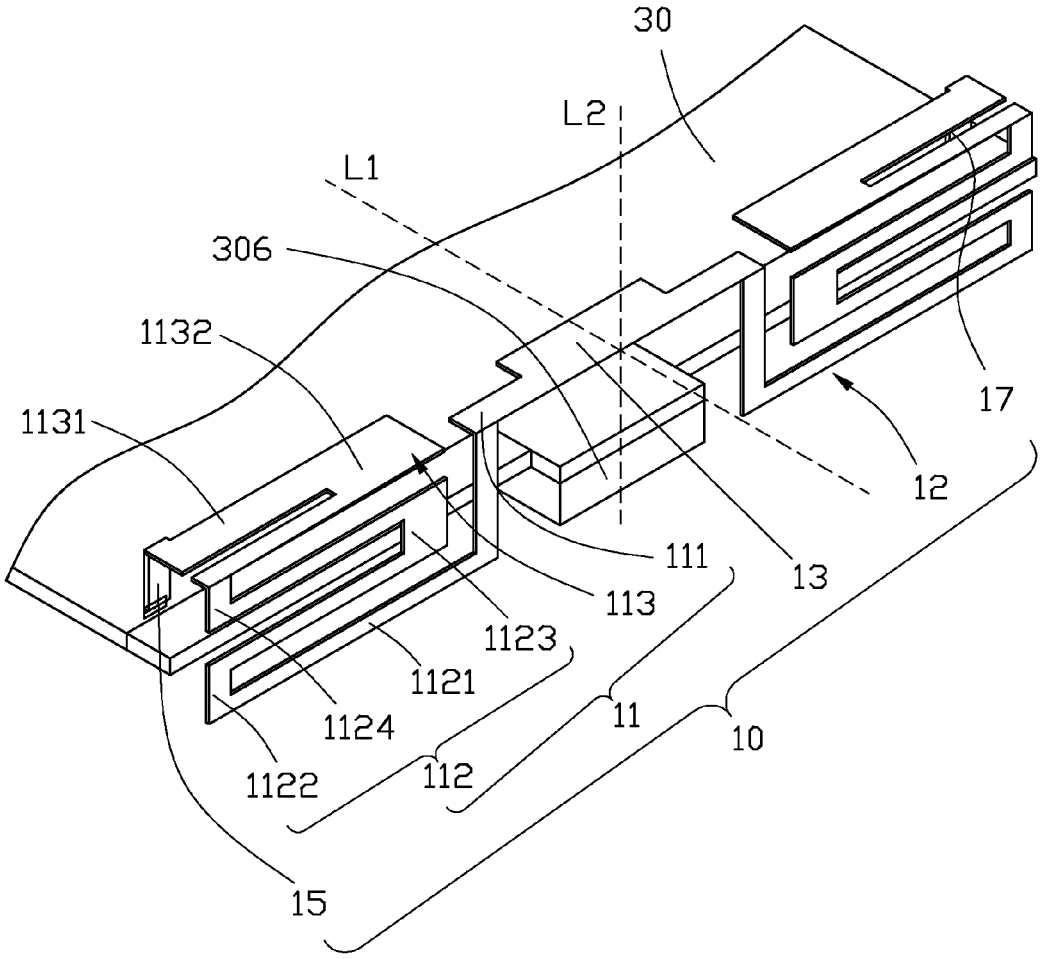
FIG. 2 is similar to FIG. 1, but showing the broadband antenna in a second view angle.

FIG. 2 shows the same exemplary embodiment of the broadband antenna of FIG. 1 in a second view angle. The broadband antenna 10 includes a first radiating body 11, a second radiating body 12, a connecting body 13 connecting between the first radiating body 11 and the second radiating body 12, a feeding portion 15 connecting to the first radiating body 11, and a grounding portion 17 connecting to the second radiating body 12. The first radiating body 11 and the second radiating body 12 are symmetrical to each other with respect to the connecting body 13.

The connecting body 13 is substantially a rectangular sheet facing and spaced apart from the connector 306. One end of the connecting body 13 is connected to the first radiating body 11, and the other opposite end is connected to the second radiating body 12. In one embodiment, the length of the connecting body 13 is about 10 mm, and a width of the connecting body 13 is about 1.75 mm.

The first radiating body 11 is a type of loop antenna and has substantially a square wave shape. In particular, the first radiating body 11 includes a first portion 111, a second portion 112, and a third portion 113, all of which are connected in series. The first portion 111 is substantially a rectangular sheet, and extends from one end of the connecting body 13. The first portion 111 is coplanar with and narrower than the connecting body 13. The second portion 112 is positioned in a plane that is substantially perpendicular to a plane in which the first portion 111 is positioned. The second portion 112 includes a first arm 1121, a second arm 1122, a third arm 1123, and a fourth arm 1124, all of which are connected in series. The first arm 1121 substantially perpendicularly extends from the first portion 111, and is formed in substantially an L-shape structure. The second arm 1122 substantially perpendicularly extends from a distal end of the first arm 1121, and is substantially a rectangular sheet. The third arm 1123 substantially perpendicularly extends from the second arm 1122 to form a substantially U-shape structure. The fourth arm 1124 substantially perpendicularly extends from one end of the third arm 1123 opposite to the second arm 1122. The fourth arm 1124 is substantially a rectangular sheet collinear with and spaced apart from the second arm 1122. The third arm 1123 is positioned in a space surrounded by the first arm 1121, the second arm 1122 and the fourth arm 1124. The third portion 113 is coplanar with and positioned adjacent to the first portion 111. The third portion 113 substantially perpendicularly extends from a distal end of the fourth arm 1124 to form a substantially U-shape structure. The third portion 113 includes two parallel arms 1131 and a connecting arm 1132 substantially perpendicularly connecting between the two parallel arms 1131. In one embodiment, a length of each arm 1131 of the third portion 113 is about 10 mm, a distance between the two parallel arms 1131 is about 0.65 mm, and a width of the connecting arm 1132 is about 4 mm.

The second radiating body 12 has a shape and size that is substantially symmetrical to the shape and size of the first radiating body 11. In particular, the first radiating body 11 and the second radiating body 12 are arranged substantially symmetrically to each other about a line L1 that passes through a center of the connecting body 13 in a plane in which the connecting body 13 is positioned, and the first radiating body 11 and the second radiating body 12 are arranged substantially symmetrically to each other about a line L2 perpendicular to the line L1 in a plane in which the second portion 112 is positioned.

The feeding portion 15 is substantially a rectangular sheet perpendicularly extending from the end of the third portion 113 opposite to the connecting body 13. The feeding portion 15 is positioned in a plane that is parallel to the plane in which the second portion 112 is positioned. A distal end of the feeding portion 15 opposite to the third portion 113 is coupled to the feeding point 302 of the PCB 30.

The grounding portion 17 is substantially a rectangular sheet perpendicularly extending from an end of the second radiating body 12 opposite to the connecting body 13. The grounding portion 17 is positioned coplanar with the feeding portion 15. A distal end of the grounding portion 17 opposite to the second radiating body 12 is coupled to the grounding point 304 of the PCB 30.

The feeding portion 15 is connected to an end of the first radiating body 11 away from the second radiating body 12, the grounding portion 17 is connected to an end of the second radiating body 12 away from the first radiating body 11, and the first radiating body 11 and second radiating body 12 are arranged symmetrically to each other. Therefore, when a current signal is fed to the feeding portion 15, the current signal flowing through the broadband antenna 10, and the power of the current signal is distributed evenly across the first radiating body 11, the second radiating body 12 and the connecting body 13, and thus a low specific absorption rate (SAR) value of the broadband antenna 10 is achieved. In addition, since the connector 306 is positioned at the center point that is centered between the grounding point 304 and the feeding point 306, circuits of the connector 306 can be arranged away from either the feeding point 306 or the grounding point 304, the current signal can be prevented from interference by the connector 306.

When the current signal is fed to the feeding portion 15 of the broadband antenna 10, the first radiating body 11 generates a first high-frequency band to receive/send wireless signals at about 1710 MHz; the first radiating body 11 resonates with the second radiating body 12 to generate a low-frequency band to receive/send signals at about 900 MHz and a second high-frequency band to receive/send wireless signals at about 2170 MHz. Accordingly, wireless communication device employing the broadband antenna 10 can be used in common wireless communication systems, such as GSM (900 MHz), WCDMA (2170 MHz), and DCS/PCS (1710 MHz), with acceptable communication quality.

Figure 3:
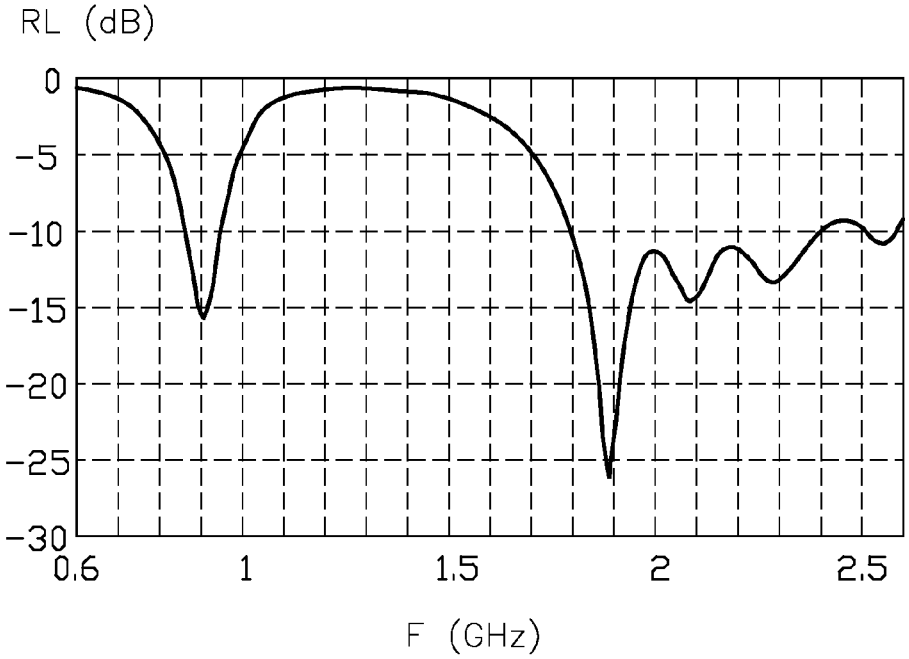
FIG. 3 is a graphical diagram showing return loss (RL) measurement of the broadband antenna shown in FIG. 1.

FIG. 3 is a graphical diagram showing return loss (RL) measurement of the broadband antenna 10 shown in FIG. 1. As shown in FIG. 3, the RL of the broadband antenna 10 is less than −6 dB when the broadband antenna 10 receives/sends wireless signals at frequencies of about between 700 MHz-960 MHz and 1700 MHz-2600 MHz. Accordingly, the broadband antenna 10 can be used in common wireless communication systems, such as GSM (900 MHz), WCDMA (2170 MHz), and DCS/PCS (1710 MHz), with exceptional communication quality.

Figure 4:
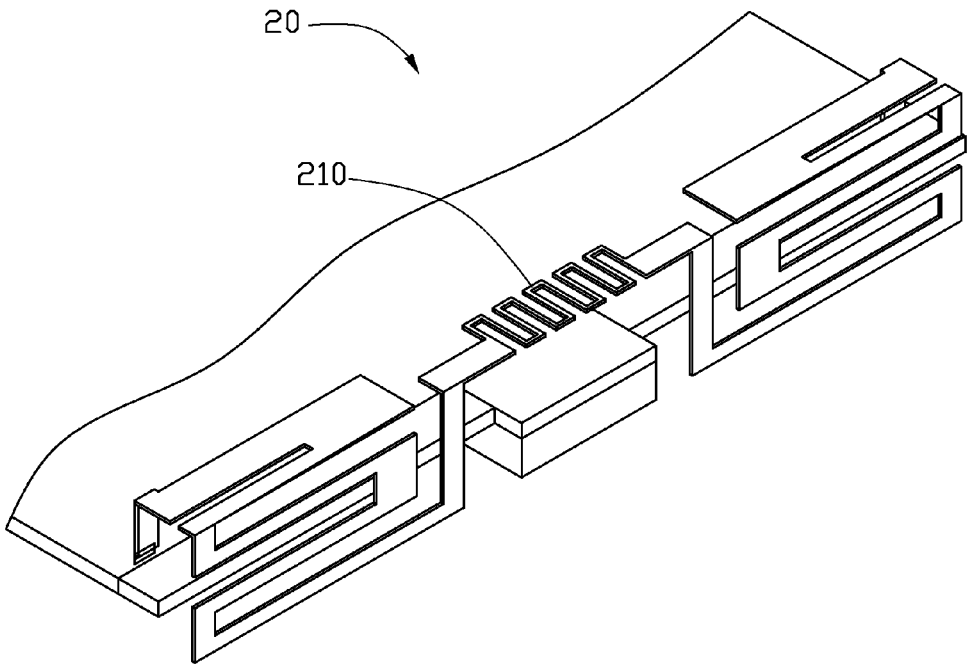
FIG. 4 is a partial perspective view of a second exemplary embodiment of the broadband antenna.

FIG. 4 is a view of a second exemplary embodiment of a broadband antenna 20. The broadband antenna 20 almost has the same shape and size as the shape and size of the broadband antenna 10, and differs from the broadband antenna 20 only in that: a connecting body 23 of the broadband antenna 20 is substantially square wave shaped. The connecting body 23 with the specific shape can construct an impedance matching of the broadband antenna 20, and an extra impedance matching circuit can be omitted.

It is believed that the exemplary embodiments and their advantages will be understood from the foregoing description, and it will be apparent that various changes can be made thereto without departing from the spirit and scope of the disclosure or sacrificing all of its material advantages, the examples hereinbefore described merely being preferred or exemplary embodiments of the disclosure.

What is claimed is:

1. A broadband antenna, comprising:

a grounding portion;

a feeding portion;

a connecting portion;

a first radiating body connected to an end of the connecting portion; and a second radiating body connected to another end of the connecting portion opposite to the first radiating body;

wherein the first radiating body and the second radiating body are symmetrical to each other with respect to the connecting body; the feeding portion is connected to an end of the first radiating body away from the second radiating body, the grounding portion is connected to an end of the second radiating body away from the first radiating body;

the first radiating body generates a first high-frequency band; the first radiating body resonates with the second radiating body to generate a low-frequency band and a second high-frequency band.

2. The broadband antenna of claim 1, wherein the first radiating body comprises a first portion, a second portion, and a third portion, all of which are connected in series, the first portion extends from and is coplanar with the connecting body, the second portion is positioned in a plane that is substantially perpendicular to a plane in which the first portion is positioned, the third portion is coplanar with the first portion.

3. The broadband antenna of claim 2, wherein the first portion is substantially a rectangular sheet, and is narrower than the connecting body.

4. The broadband antenna of claim 2, wherein the second portion comprises a first arm, a second arm, a third arm, and a fourth arm, all of which are connected in series, the first arm perpendicularly extends from the first portion, and is substantially L shaped; the second arm perpendicularly extends from a distal end of the first arm, and is substantially a rectangular sheet; the third arm perpendicularly extends from the second arm to form a substantially U-shape structure; the fourth arm perpendicularly extends from one end of the third arm opposite to the second arm.

5. The broadband antenna of claim 4, wherein the fourth arm is substantially a rectangular sheet collinear with and spaced apart from the second arm, the third arm is positioned in a space surrounded by the first, second and fourth arms.

6. The broadband antenna of claim 5, wherein the third portion is coplanar with and positioned adjacent to the first portion; the third portion perpendicularly extends from a distal end of the fourth arm to form a substantially U-shape structure.

7. The broadband antenna of claim 2, wherein the first radiating body and the second radiating body are arranged substantially symmetrically to each other about a first line that passes through a center of the connecting body in a plane in which the connecting body is positioned, and the first radiating body and the second radiating body are arranged substantially symmetrically to each other with respect to a second line perpendicular to the first line in a plane in which the second portion is positioned.

8. A wireless communication device, comprising:

a printed circuit board (PCB) comprising a grounding point and a feeding point; and a broadband antenna mounted on the PCB, comprising:

a grounding portion electrically connected to the grounding point;

a feeding portion electrically connected to the feeding point;

a connecting portion;

a first radiating body connected to an end of the connecting portion; and a second radiating body connected to another end of the connecting portion opposite to the first radiating body;

wherein the first radiating body and the second radiating body are symmetrical to each other with respect to the connecting body; the feeding portion is connected to an end of the first radiating body away from the second radiating body, the grounding portion is connected to an end of the second radiating body away from the first radiating body;

the first radiating body generates a first high-frequency band; the first radiating body resonates with the second radiating body to generate a low-frequency band and a second high-frequency band.

9. The wireless communication device of claim 8, wherein the first radiating body comprises a first portion, a second portion, and a third portion, all of which are connected in series, the first portion extends from and is coplanar with the connecting body, the second portion is positioned in a plan that is substantially perpendicular to a plane in which the first portion is positioned, the third portion is coplanar with the first portion.

10. The wireless communication device of claim 9, wherein the first portion is substantially a rectangular sheet, and is narrower than the connecting body.

11. The wireless communication device of claim 9, wherein the second portion comprises a first arm, a second arm, a third arm, and a fourth arm, all of which are connected in series, the first arm perpendicularly extends from the first portion, and is substantially L-shaped; the second arm perpendicularly extends from a distal end of the first arm, and is substantially a rectangular sheet; the third arm perpendicularly extends from the second arm to form a substantially U-shape structure; the fourth arm perpendicularly extends from one end of the third arm opposite to the second arm.

12. The wireless communication device of claim 11, wherein the fourth arm is substantially a rectangular sheet collinear with and spaced apart from the second arm, the third arm is positioned in a space surrounded by the first, second and fourth arms.

13. The wireless communication device of claim 12, wherein the third portion is coplanar with and positioned adjacent to the first portion; the third portion perpendicularly extends from a distal end of the fourth arm to form a substantially U-shape structure.

14. The wireless communication device of claim 9, wherein the first radiating body and the second radiating body are arranged substantially symmetrically to each other about a first line that passes through a center of the connecting body in a plane in which the connecting body is positioned, and the first radiating body and the second radiating body are arranged substantially symmetrically to each other about a second line that is perpendicular to the first line in a plane in which the second portion is positioned.

15. The wireless communication device of claim 8, wherein the PCB further comprising a connector positioned between a center point that is centered between the grounding point and the feeding point.

16. The wireless communication device of claim 15, wherein the connecting portion is positioned facing and spaced apart from the connector.

17. A broadband antenna, comprising:

a grounding portion;

a feeding portion;

a connecting portion;

a first radiating body connected to an end of the connecting portion, the first radiating body comprising:

a first portion extending from and is coplanar with the connecting body;

a second portion positioned in a plane that is substantially perpendicular to a plane in which the first portion is positioned, and a third portion coplanar with the first portion, all of the first, second and third portions connected in series; and a second radiating body connected to another end of the connecting portion opposite to the first radiating body;

wherein the first radiating body and the second radiating body are symmetrical to each other with respect to the connecting body; the feeding portion is connected to an end of the first radiating body away from the second radiating body, the grounding portion is connected to an end of the second radiating body away from the first radiating body.

18. The broadband antenna of claim 17, wherein the first portion is substantially a rectangular sheet, and is narrower than the connecting body.

19. The broadband antenna of claim 18, wherein the second portion comprises a first arm, a second arm, a third arm, and a fourth arm, all of which are connected in series, the first arm perpendicularly extends from the first portion, and is substantially L shaped; the second arm perpendicularly extends from a distal end of the first arm, and is substantially a rectangular sheet; the third arm perpendicularly extends from the second arm to form a substantially U-shape structure; the fourth arm perpendicularly extends from one end of the third arm opposite to the second arm.

20. The broadband antenna of claim 19, wherein the fourth arm is substantially a rectangular sheet collinear with and spaced apart from the second arm, the third arm is positioned in a space surrounded by the first, second and fourth arms.

* * * * *